US005564709A

United States Patent [19]

Smolka

[11] Patent Number: 5,564,709

[45] Date of Patent: Oct. 15, 1996

[54] PHOTO-FINISH HORSE RACE GAME

[76] Inventor: Richard G. Smolka, 5620 33rd St., NW., Washington, D.C. 20015

[21] Appl. No.: 582,884

[22] Filed: Jan. 4, 1996

[51] Int. Cl.[6] ..... A63F 3/00

[52] U.S. Cl. ..... 273/246

[58] Field of Search ..... 273/243, 246, 273/248, 249, 138 R, 139, 142 R, 143 R

[56] References Cited

U.S. PATENT DOCUMENTS

| | | | |
|---|---|---|---|
| 724,244 | 3/1903 | Bawden | 273/246 |
| 1,797,742 | 3/1931 | Ward | 273/246 |
| 2,252,516 | 8/1941 | Le May | 273/246 X |
| 2,719,718 | 10/1955 | Rothgery | 273/246 X |
| 2,810,578 | 10/1957 | Pacitti | 273/246 |
| 3,117,790 | 1/1964 | White | 273/246 |
| 4,010,956 | 3/1977 | Zyla et al. | 273/246 |
| 4,729,568 | 3/1988 | Welsh | 273/246 |
| 4,817,956 | 4/1989 | Fogliani | 273/246 |
| 4,917,386 | 4/1990 | Tozer | 273/246 |
| 5,106,098 | 4/1992 | Filiczkowski | 273/246 |
| 5,114,152 | 5/1992 | Rouse et al. | 273/246 |

*Primary Examiner*—William E. Stoll
*Attorney, Agent, or Firm*—Brady O'Boyle & Gates

[57] ABSTRACT

A photo-finish horse race game having a photo-finish assembly for determining the winner of the game when a pair of manually movable game pieces, simulating horses, stop at the finish line in a dead heat. A freely rotatable disc is mounted in a housing having a window, and indicia is on the disk indicating the winning horse and viewable through the window. The indicia includes at least two pairs of horse necks and heads, one pair showing the head of the inside horse ahead of the ourside horse and the other pair of horse necks and heads showing the head of the outside horse ahead of the inside horse.

5 Claims, 3 Drawing Sheets

PHOTO-FINISH HORSE RACE GAME

BACKGROUND OF THE INVENTION

Various games simulating a horse race have been proposed wherein a game board is provided having a race track printed thereon with the track lanes divided into increments. Game pieces simulating horses are also provided which are movable on the game board incrementally depending upon the roll of dice. Each player has a respective game piece and, in turn, rolls the dice to determine how many increments his or her game piece can be advanced around the track. The player whose game piece crosses the finish line first wins the game. At times, two players' game pieces will land at the finish line but not cross the line; therefore, the next roll of the dice by one of the two players next in turn will determine the winner.

While these horse race games have been satisfactory for their intended purpose, after considerable research and experimentation, the photo-finish horse race game of the present invention has been devised to add further excitement and anticipation to the horse race game so that in case of a photo-finish, that is, two game pieces landing at the finish line, in a dead heat, the winner will not be determined by the person having next roll of the dice, so that each of the two players ending in a photo-finish will have an equal chance to win the game.

SUMMARY OF THE INVENTION

The photo-finish horse race game of the present invention comprises, essentially, a game board having a simulated race track superimposed thereon with the track lanes divided into increments. A plurality of game pieces simulating horses are provided the players and are movable around the track incrementally depending upon the roll of dice by each player, in turn. To determine the winner of the game in the event of a photo-finish, a freely rotatable disc is provided in the game board. A portion of the disc is viewable through a window provided in the game board, and indicia is provided on the disc to determine the winner. The indicia consists of a plurality of pairs of horse necks and heads, wherein one pair shows the inside horse as the winner, and another pair shows the outside horse as the winner. By this construction and arrangement, in the event of a photo-finish, any one of the players can rotate the disc and depending upon which pair of horse heads appear in the window when the disc stops, either the inside or outside horse will be determined the winner, whereby each of the two players ending in a photo-finish will have an equal chance to win the horse race, thereby adding further excitement to the game.

DESCRIPTION OF THE PREFERRED EMBODIMENTS

Figure 1:
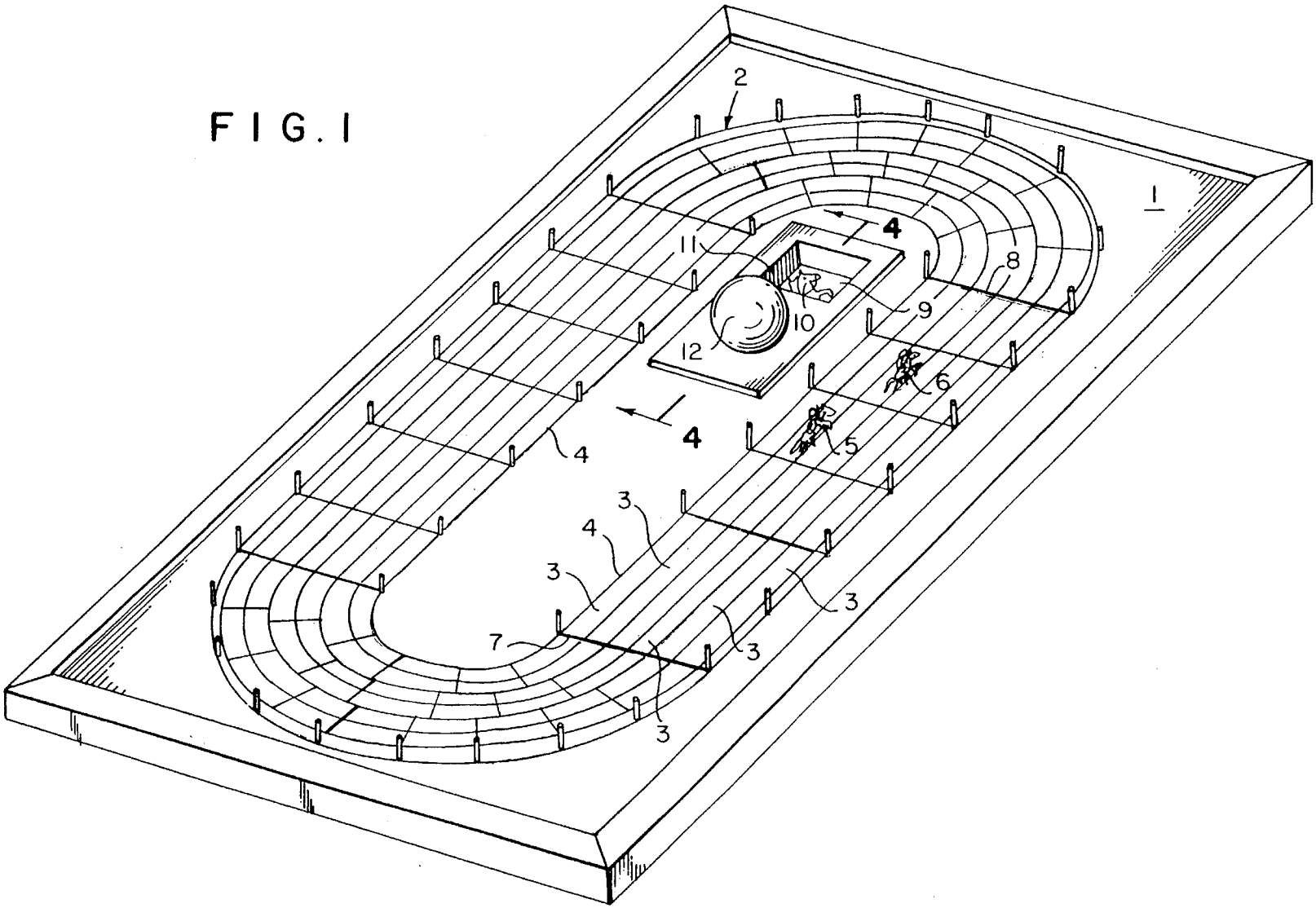
FIG. 1 is a perspective view of the photo-finish horse race game board of the present invention.

Referring to the drawings and, more particularly to FIG. 1, the photo-finish horse race game of the present invention comprises a game board 1 having a simulated race track 2 thereon with the track lanes 3 divided into increments 4. A plurality of game pieces simulating horses 5 and 6 are provided the players and are movable around the track incrementally depending upon the roll of dice, not shown, by each player, in turn. The game pieces 5 and 6 begin at the "starting gate" 7 and go once around the track to the finish line 8.

To determine the winner of the game in the event of a dead heat, a photo-finish assembly is provided, comprising a freely rotatable disc 9 having indicia 10 thereon, mounted in the game board 1 and viewable through a window 11 provided in the game board. A spherical handle 12 is connected to the disc 9 for manually rotating the disc 9.

Figure 2:
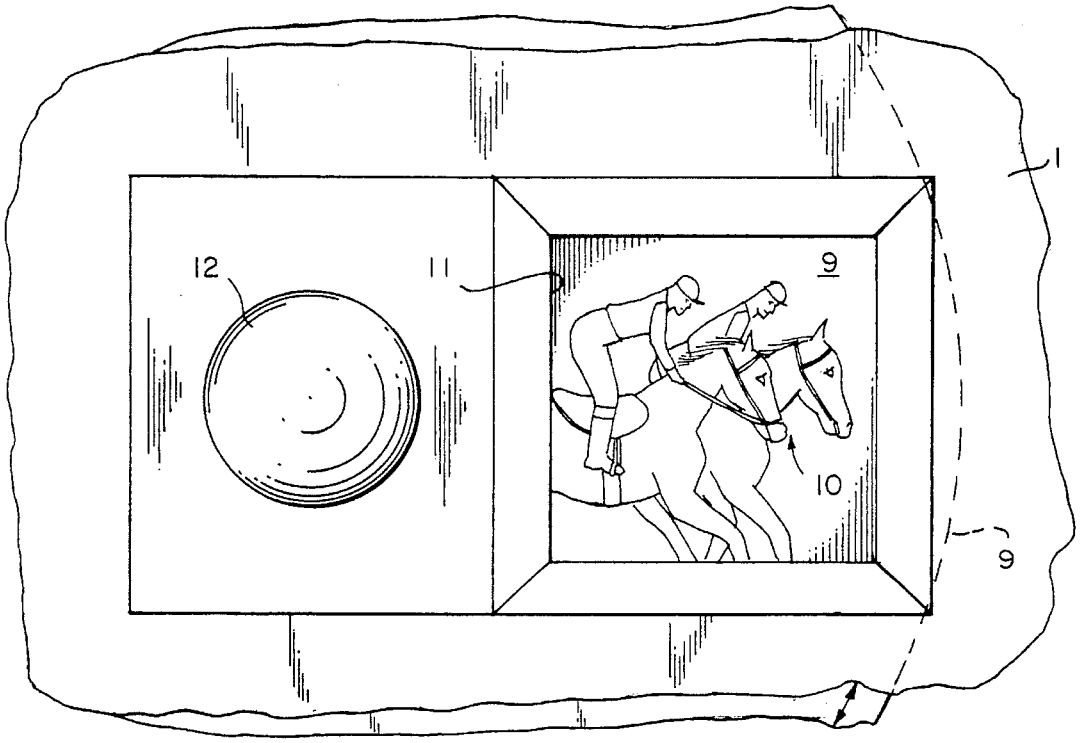
FIG. 2 is an enlarged fragmentary, top plan view of the portion of the game board containing a window through which a portion of the rotatable photo-finish disc is viewable.
Figure 3:
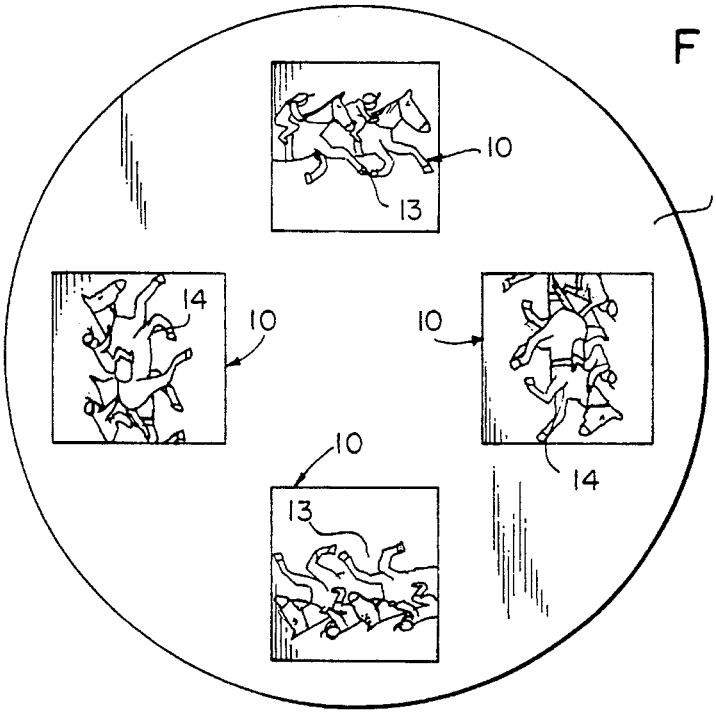
FIG. 3 is a top plan view of the disc having the pairs of horse necks and heads thereon, one pair showing the inside horse ahead of the outside horse, and the other pair showing the outside horse ahead of the inside horse.

As will be seen in FIGS. 2 and 3, the indicia 10 on the rotatable disc 9 consists of two pairs of horse necks and heads, wherein one pair 13 shows the inside horse ahead of the outside horse, and the other pair 14 wherein the outside horse is ahead of the inside horse. Two sets of each pair are provided on the disc 9 to ensure that at least one pair will appear in the window 11 when the disc 9 stops.

Figure 4:
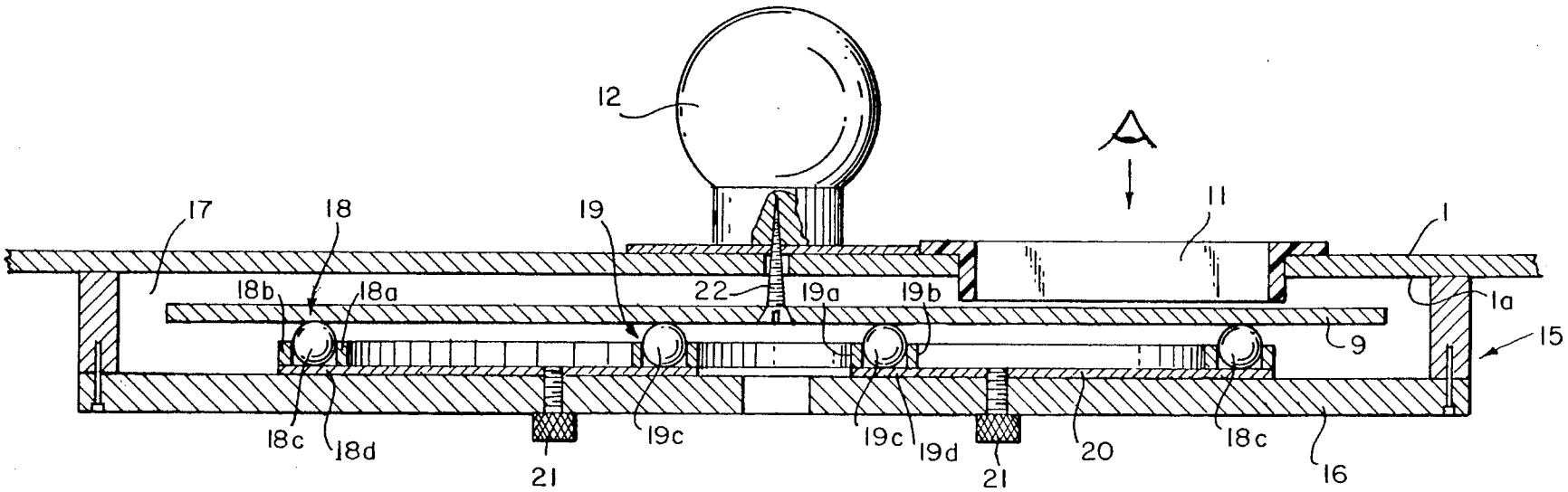
FIG. 4 is a view taken along line 4—4 of FIG. 1.

The details of the construction of the rotatable disc assembly 9 is shown in FIG. 4, wherein a housing 15 having a floor 16 is secured to the bottom surface 1*a* of the game board 1 and depends therefrom to provide a chamber 17 containing the disc 9. The disc 9 is positioned in the chamber 17 below the bottom surface 1*a* of the game board 1, and above the floor 16 of the housing 15. The disc is supported above the housing floor 16 by a pair of ball bearing assemblies 18 and 19, each having respective inner and outer races 18*a*, 18*b*, 19*a*, 19*b* containing ball bearings 18*c* and 19*c*. The inner and outer races of each bearing assembly 18 and 19 are integral with a respective area 18*d* and 19*d* of a flat plate member 20 secured to the housing floor 16 by bolts 21. A suitable fastener 22 extends upwardly from the center of the disc 9 and into the spherical handle 12, whereby when the handle 12 is manually turned to rotate the disc 9 and then let go, the disc 9 will freely rotate on the bearing assemblies 18 and 19 until the disc 9 comes to rest; whereupon, the indicia 10 on the disc will be viewable through the window 11. If the one pair 13 of horse necks and heads appears in the window 11, the inside horse; that is, the horse in the lane closest to the track infield, is ahead of the outside horse, and therefore, the winner of the race. If the other pair 14 of horse necks and heads appears in the window 11, then the outside horse is the winner.

From the above description, it will be readily appreciated by those skilled in the art that the photo-finish feature provided by the rotatable disc having the horse head and neck indicia thereon adds excitement to the game for determining the winner when the game pieces in the race end at the finish line in a dead heat. Until the disc 9 has been rotated, it is still any player's chance to win, whose horse is in the dead heat.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A photo-finish horse race game comprising a game board, a simulated race track on said game board, indicia on said track defining parallel track lanes, a plurality of spaced transversely, extending lines dividing the lanes into increments, a plurality of game pieces simulating horses manually movable incrementally around the track, one of the transverse lines defining a starting position, another transverse line defining a finish line, and a photo-finish assembly for determining the winner when a pair of game pieces stop at the finish line in a dead heat, said photo-finish assembly comprising a housing, a disc freely rotatably mounted in said housing, indicia on said disc indicating a winning horse, a window in said housing through which the indicia on said disc is viewable, and a handle connected to said disc for spinning said disc, whereby when the handle is manually turned to rotate the disc and then let go, the disc freely rotates in the housing until the disc comes to rest, thereby positioning the indicia at the window, whereby the winner can be determined.

2. A photo-finish horse game according to claim 1 wherein the indicia comprises, at least two pairs of horse necks and heads, one pair showing the head of the inside horse ahead of the outside horse, the other pair of horse necks and heads showing the head of the outside horse ahead of the inside horse.

3. A photo-finish horse game according to claim 2, wherein the indicia comprises two sets of each pair of horse necks and heads, to thereby ensure that at least one pair of horse necks and heads will appear in the window when the disc stops.

4. A photo-finish horse game according to claim 1, wherein the housing is secured to the bottom surface of the game board and depends therefrom, said housing including a floor, the disc being positioned in said housing between the floor and bottom surface of said game board, bearing means on the floor of the housing supporting the disc, and fastening means extending from the center of the disc through the game board into the handle.

5. A photo-finish horse game according to claim 4, wherein the bearing means comprises a pair of ball bearing assemblies, each bearing assembly having an inner race and an outer race, ball bearings being mounted between the inner and outer race in each bearing assembly, a plate member extending between the pair of ball bearing assemblies and being integral with the respective inner and outer races, and fastening means securing the plate and associated pair of ball bearing assemblies to the floor of the housing.

* * * * *